US011085408B2

(12) United States Patent
Oh et al.

(10) Patent No.: US 11,085,408 B2
(45) Date of Patent: Aug. 10, 2021

(54) PULSATION DAMPENING STRUCTURE FOR FUEL RAIL

(71) Applicant: HYUNDAI KEFICO CORPORATION, Gyeonggi-do (KR)

(72) Inventors: Seung Hyuk Oh, Gyeonggi-do (KR); Kwang Won Koo, Seoul (KR); Yeon Jee Oh, Seoul (KR)

(73) Assignee: HYUNDAI KEFICO CORPORATION, Gyeonggi-do (KR)

( * ) Notice: Subject to any disclaimer, the term of this patent is extended or adjusted under 35 U.S.C. 154(b) by 122 days.

(21) Appl. No.: 16/234,351

(22) Filed: Dec. 27, 2018

(65) Prior Publication Data

US 2019/0203685 A1 Jul. 4, 2019

(30) Foreign Application Priority Data

Dec. 28, 2017 (KR) ..... 10-2017-0182242

(51) Int. Cl.
*F02M 55/02* (2006.01)
*F02M 63/02* (2006.01)

(52) U.S. Cl.
CPC ..... *F02M 55/025* (2013.01); *F02M 63/023* (2013.01); *F02M 63/0275* (2013.01); *F02M 2200/315* (2013.01)

(58) Field of Classification Search
CPC ..... F02M 55/025; F02M 2200/315; F02M 63/023; F02M 63/0275
See application file for complete search history.

(56) References Cited

U.S. PATENT DOCUMENTS 5,644,914 A * 7/1997 Deavers ..... F01N 13/004 440/88 G
6,892,704 B2 * 5/2005 Tsuchiya ..... F02M 55/025 123/456
9,074,565 B2 * 7/2015 Ramamurthy ..... F02M 55/025
2016/0341167 A1 * 11/2016 Zdroik ..... F02M 63/0275

FOREIGN PATENT DOCUMENTS

JP 2000320422 A * 11/2000 ..... F02M 69/465
JP 2005-076478 A 3/2005
KR 10-1189371 B1 10/2012

OTHER PUBLICATIONS

Takigawa, JP 2003-320422, Nov. 21, 2000, machine translation (Year: 2000).*

* cited by examiner

*Primary Examiner* — Hung Q Nguyen
*Assistant Examiner* — Mark L. Greene
(74) *Attorney, Agent, or Firm* — Mintz Levin Cohn Ferris Glovsky and Popeo, P.C.; Peter F. Corless

(57) ABSTRACT

The present disclosure relates to a pulsation dampening structure for a vehicle. The pulsation dampening structure includes a fuel rail, a rail plug disposed at an end portion of the fuel rail, and a pulsation dampening part disposed on the rail plug to dampen pulsation generated when fuel enters. A turbulent flow is caused by reflecting fuel which was entered, and a vortex is generated in the fuel, thereby dampening pulsation.

6 Claims, 5 Drawing Sheets

PULSATION DAMPENING STRUCTURE FOR FUEL RAIL

CROSS-REFERENCE TO RELATED APPLICATIONS

This application claims priority to Korean Patent Application No. 10-2017-0182242, filed on Dec. 28, 2017, which is incorporated herein by reference in its entirety.

TECHNICAL FIELD

The present disclosure relates to a pulsation dampening structure for a fuel rail, and more particularly, to a pulsation dampening structure for a fuel rail configured to dampen pulsation generated in the fuel rail when fuel flows into the fuel rail which supplies fuel to an engine of a vehicle.

RELATED ART

Generally, a fuel device of a vehicle is a system for continuously supplying fuel, which is injected into a combustion chamber of an engine, in an appropriate amount based on the control of the engine. The fuel device is configured to allow fuel suctioned and pumped along a pipe line by a fuel pump from a fuel tank to flow into a plurality of injectors disposed in the combustion chamber of the engine and to be injected by the plurality of injectors. A precipitator and a fuel filter are installed on a pipe line between the fuel tank and the fuel pump to provide precipitation and filtration for foreign substance and the like, and a delivery pipe connected to the fuel pump through another pipe line is coupled to the plurality of injectors.

In a typical fuel injection system for the vehicle, when fuel stored in the fuel tank is pumped by the fuel pump and supplied to the fuel delivery pipe as the engine is operated, a fuel pressure in the fuel delivery pipe is maintained constant by a pressure regulator provided at one side of the fuel delivery pipe. In addition, by adjusting an electrical pulse time to the fuel injector by an output signal inputted to an electronic control unit (ECU) based on a load state of the engine, as each of fuel injectors injects fuel sequentially, proper fuel injection based on engine load conditions can be achieved.

In other words, the injector receives an injection signal from the ECU and operates a pin provided in the injector to repeat periodical inject of fuel. At this time, a pressure in the delivery pipe drops corresponding to an amount of fuel which is being injected, and fuel is continuously supplied into the delivery pipe to maintain the pressure in the pipe. For this reason, pulsation is generated in the delivery pipe due to the repetition of fuel injection and fuel supply.

In addition, when pulsation is generated, irregular injection occurs in the injector, irregular combustion of fuel is caused by the irregular injection, and engine output becomes unstable due to the irregular combustion. Pulsation generated in the fuel delivery pipe is an important issue in vehicle development, and an insulator and a damper have generally been added to a fuel hose line, or various other methods have been tried to improve the pulsation problem.

SUMMARY

The present disclosure is devised to improve drawbacks of a conventional pulsation dampening structure for a fuel rail as described above, and an object of the present disclosure is to provide a pulsation dampening structure for a fuel rail, which generates a turbulent flow or a vortex to dampen pulsation generated when fuel enters.

In an aspect of the present disclosure, a pulsation dampening structure for a vehicle according to the present disclosure may include a fuel rail, a rail plug disposed at an end portion of the fuel rail to maintain an airtightness of the fuel rail, and a pulsation dampening part disposed on the rail plug to dampen pulsation generated when fuel enters. Further, the rail plug may include a plug body inserted into and coupled to the end portion of the fuel rail, and a fuel reflecting part disposed on the plug body in an inflow direction of the fuel and concavely formed in the inflow direction of the fuel such that the fuel entering along the fuel rail may be reflected and concentrated.

In addition, the pulsation dampening part may include a turbulent flow generating portion provided in the fuel inflow direction of the fuel reflecting part to generate a vortex in the fuel reflected on the fuel reflecting part, and a coupling bridge connected to the turbulent flow generating portion for coupling the turbulent flow generating portion and the plug body.

The turbulent flow generating portion may be concavely formed in the direction of the fuel reflecting part to reflect the fuel, which is reflected on the fuel reflecting part, again and to form a vortex. The coupling bridge may include a first bending portion formed to protrude from the turbulent flow generating portion in a radial direction and bent in a direction toward the rail plug, an extension portion formed to extend from the first bending portion in the direction toward the rail plug, a second bending portion formed to bend radially outward at the extension portion, and a coupling portion formed to extend from the second bending portion and configured to be coupled to the rail plug.

The extension portion may be formed to have a length that is less than a focal distance of a curvature of the fuel reflecting portion. The plug body may include a plurality of coupling grooves in a circumferential direction to allow the coupling bridge to be inserted thereinto and coupled thereto.

In another aspect of the present disclosure, the pulsation dampening part may be formed to protrude from the fuel reflecting part in an inflow direction of fuel to allow a vortex to be generated in fuel that enters along the fuel rail. In particular, the pulsation dampening part may be formed to have a spheroidal shape which is pointed in the inflow direction of fuel, and may be formed to have a base diameter smaller than a diameter of the fuel reflecting part.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
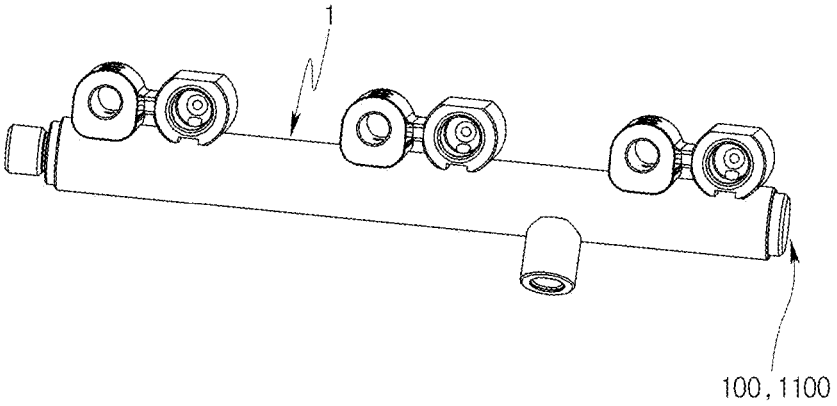
FIG. 1 is a perspective view of a fuel rail in a pulsation dampening structure for a fuel rail according to an exemplary embodiment of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Hereinafter, exemplary embodiments of the present disclosure will be described in detail with reference to the accompanying drawings. However, in the following description and the accompanying drawings, a detailed description of well-known functions or configurations that may obscure the subject of the present disclosure will be omitted. In addition, it should be noted that the same components are denoted by the same reference numerals as much as possible throughout the entire drawings.

Figure 2:
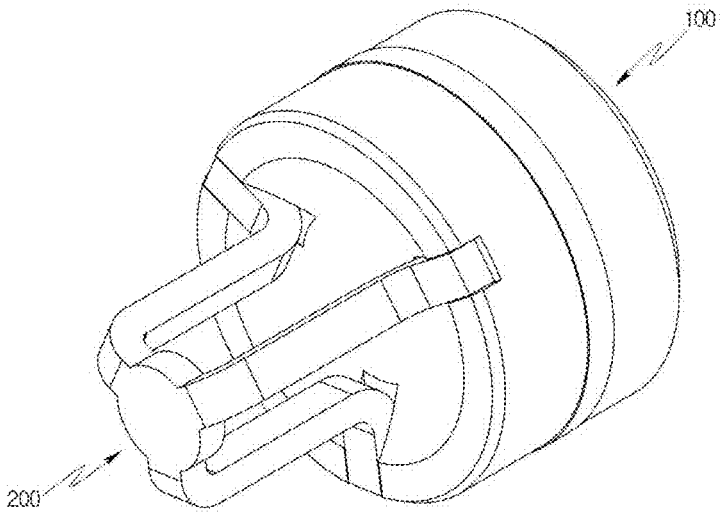
FIG. 2 is a perspective view illustrating a state in which a rail plug and a pulsation dampening part are coupled to each other in the pulsation dampening structure for the fuel rail according to an exemplary embodiment of the present disclosure.
Figure 3:
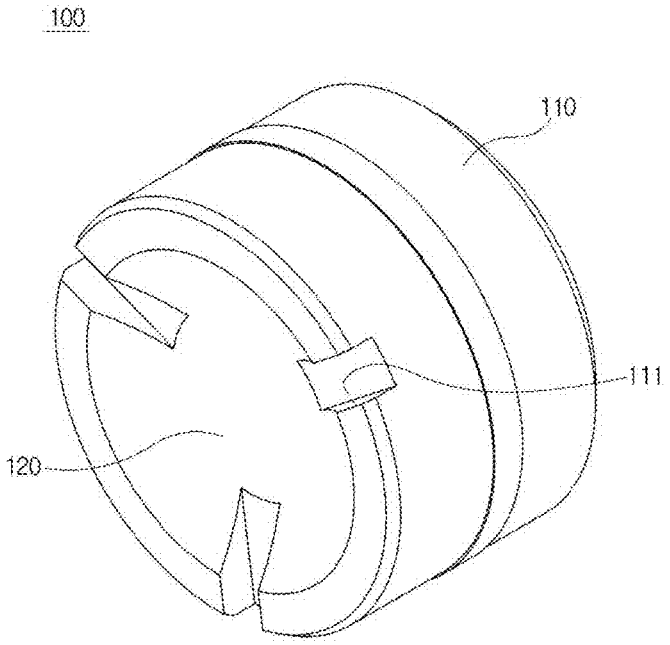
FIG. 3 is a perspective view of the rail plug in the pulsation dampening structure for the fuel rail according to an exemplary embodiment of the present disclosure.

Referring to FIGS. 1 to 3, a pulsation dampening structure for a fuel rail according to an exemplary embodiment of the present disclosure may include a fuel rail 1, a rail plug 100, and a pulsation dampening part 200. The rail plug 100 may be disposed at one side end portion of the fuel rail 1 (e.g., an end portion opposite to an inlet of fuel that flows in from a fuel tank) and the pulsation dampening part 200 may be coupled to the rail plug 100.

The fuel rail 1 may be formed in the shape of a pipe for allowing fuel stored in a fuel tank (not shown in the drawings) of a vehicle to flow into an engine (not shown the drawing) of the vehicle. In an exemplary embodiment, the fuel rail 1 may be used in a gasoline direct injection engine to store fuel transferred from a high-pressure pump (not shown in the drawing) and may be coupled with an injection device (injector; not shown in the drawing) to inject the fuel into a cylinder of the engine (not shown). However, the present disclosure is not limited thereto and may include a fuel rail for a vehicle in which pulsation is generated.

The rail plug 100 may include a plug body 110 and a fuel reflecting part 120. The plug body 110 may be formed to be inserted into the fuel rail 1. In the exemplary embodiment, the plug body 110 may be formed in a cylindrical shape, but is not limited thereto and may be formed to correspond substantially to a shape of the fuel rail 1. In the exemplary embodiment, a plurality of coupling grooves 111 may be formed in the plug body 110 along a circumferential direction to allow the pulsation dampening part 200 to be inserted thereinto and coupled thereto.

The fuel reflecting part 120 may be connected to the plug body 110 and may be concavely formed in an inflow direction of fuel. In particular, the fuel reflecting part 120 may be disposed at one side end of the fuel rail 1, which is opposite to the inflow direction of fuel, and may be formed in a shape similar to a concave mirror.

Figure 4:
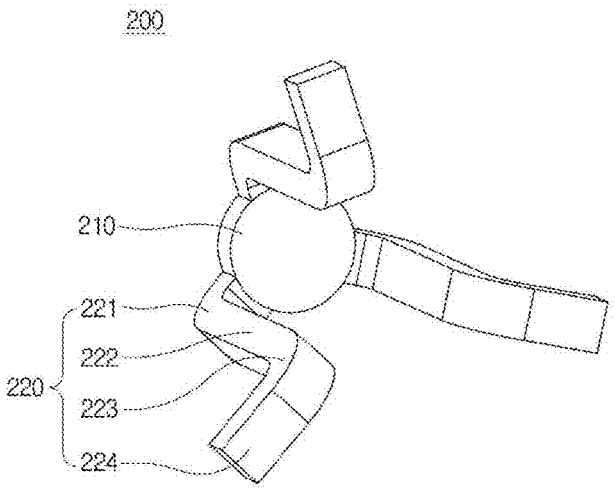
FIG. 4 is a perspective view of the pulsation dampening part in the pulsation dampening structure for the fuel rail according to an exemplary embodiment of the present disclosure.

Referring to FIGS. 3 and 4, the pulsation dampening part 200 may be coupled to the rail plug 100 and may be disposed inside the fuel rail 1. The pulsation dampening part may include a turbulent flow generating portion 210 and a coupling bridge 220. The turbulent flow generating portion 210 may be disposed in a direction in which the fuel flows, with respect to the rail plug 100, and may be disposed to face the fuel reflecting part 120. Further, the turbulent flow generating portion 210 may be formed to be concave toward the fuel reflecting part 120. Accordingly, the fuel reflecting part 120 and the turbulent flow generating portion 210 may be formed in a shape similar to a pair of concave mirrors that face each other.

The coupling bridge 220 may couple the rail plug 100 and the turbulent flow generating portion 210 with each other. The coupling bridge 220 may be formed to extend from the turbulent flow generating portion 210, and may be inserted into the coupling groove 111 of the plug body 110 and coupled thereto.

Furthermore, the coupling bridge 220 may include a first bending portion 221, an extension portion 222, a second bending portion 223, and a coupling portion 224. In particular, a plurality of the first bending portions 221 may be formed to protrude from the turbulent flow generating portion 210 in a radial direction and bent in a direction toward the rail plug 100, and the extension portion 222 may be formed to extend from the first bending portion 221 in the direction toward the rail plug 100. In the exemplary embodiment, the extension portion 222 may be formed to have a length D that is less than a focal distance F of a curvature of the fuel reflecting part 120 ($D<F$), but the present disclosure is not limited thereto. The second bending portion 223 may be formed to bend radially outward from the extension portion 222, and the coupling portion 224 may be formed to radially extend from the second bending portion 223 and may be configured to be received in the coupling groove 111 of the plug body 110.

Referring to FIGS. 1-4 and 6, an effect of the pulsation dampening structure for the fuel rail according to an exemplary embodiment of the present disclosure is described. First, when the fuel enters along the fuel rail 1, the fuel may reach the rail plug 100 disposed at the end portion of the fuel rail 1. Due to the fuel reflecting part 120 formed on the rail plug 100, the fuel may be reflected on a concave surface of the fuel reflecting part 120. In particular, the fuel along the flow pathlines which move linearly along the fuel rail 1 may collide with the fuel reflecting part 120 and may then be reflected toward a focal point based on a curvature of the fuel reflecting part 120. Therefore, the fuel reflected on the fuel reflecting part 120 may be collected and collide with each other to generate turbulent flow. As a result, pulsation may be dampened (e.g., decreased or reduced).

In the present disclosure, the fuel reflected on the fuel reflecting part 120 may collide with the turbulent flow generating portion 210. In particular, in the exemplary embodiment, the extension portion 222 of the coupling bridge 220 may be formed to have the length D that is less than the focal distance F of the curvature of the fuel reflecting part 120 to allow a turbulent flow to be generated between the fuel reflecting part 120 and the turbulent flow generating portion 210. As a result, the pulsation may be dampened at the end portion of the fuel rail 1, and the influence on fuel injection may be minimized. In the exemplary embodiment, the turbulent flow generating portion 210 may also be concavely formed to further concentrate (e.g., focus or collimate) the fuel reflected on the turbulent flow generating portion 210 again, thereby enhancing the effect of turbulent flow generation.

Figure 8:
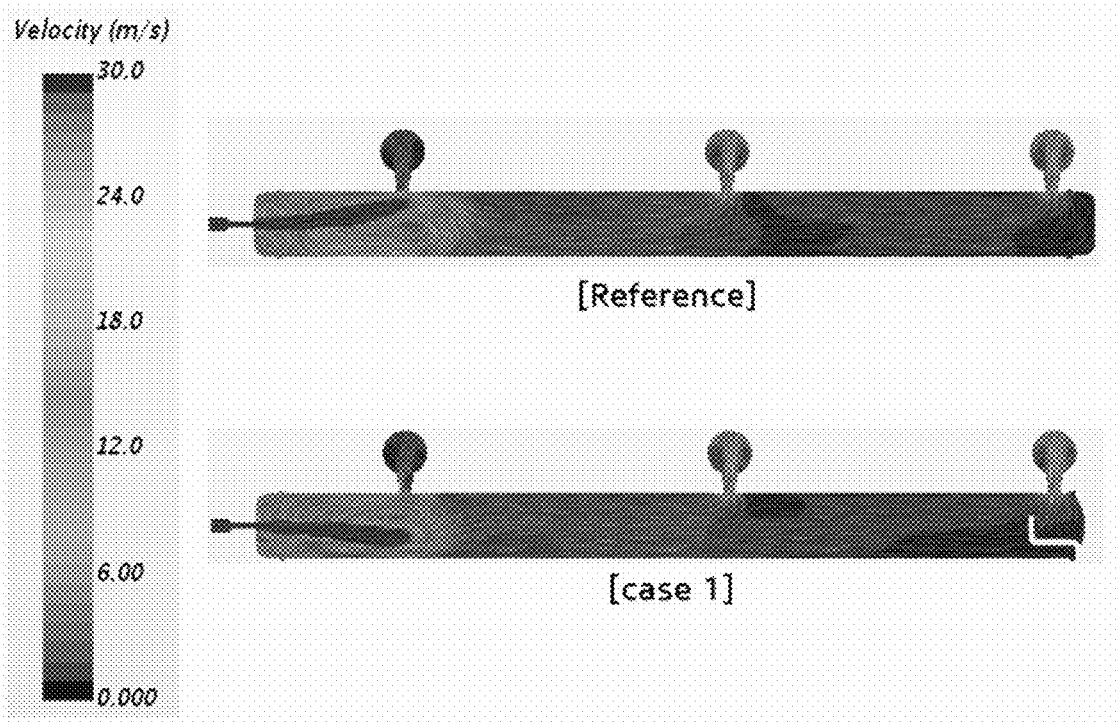
FIG. 8 is a flow analysis view indicating a fuel flow inside the fuel rail to which the pulsation dampening structure for the fuel rail according to an exemplary embodiment of the present disclosure is applied.

FIG. 8 illustrates a flow analysis view indicating the result of comparing a fuel flow inside the fuel rail to which the pulsation dampening structure for the fuel rail according to an exemplary embodiment of the present disclosure is applied (referred to as "case 1") with a fuel flow inside a conventional fuel rail (referred to as "reference"). In the conventional fuel rail in FIG. 8, the flow (bright region: flow velocity of 20 m/s or more) of fuel returns back to an inlet port with the flow (dark region: flow velocity of 30 m/s or more) of fuel flowing into the vicinity of the inlet port. In particular, since a large amount of fuel is returned, the flow of inflowing fuel is considerably bent (e.g., deflected). In contrast, in the fuel rail to which the present disclosure is applied, the flow of fuel (bright region) returned back to an inlet port is relatively weak, and the flow of inflowing fuel is deflected less.

In addition, around the end portion of the fuel rail in the direction of the rail plug, when compared to the conventional fuel rail, the region darkly represented is distributed more widely in the fuel rail to which the present disclosure is applied. The region darkly represented inside the fuel rail may indicate that the flow velocity of fuel is low (0 m/s or more, equal to or less than 1 m/s) and that pulsation is reduced due to the low flow velocity. Therefore, according to the exemplary embodiment, a turbulent flow may be generated in the fuel, which enters along the fuel rail 1, by the fuel reflecting part 120 and the turbulent flow generating portion 210, thereby dampening the pulsation.

Figure 5:
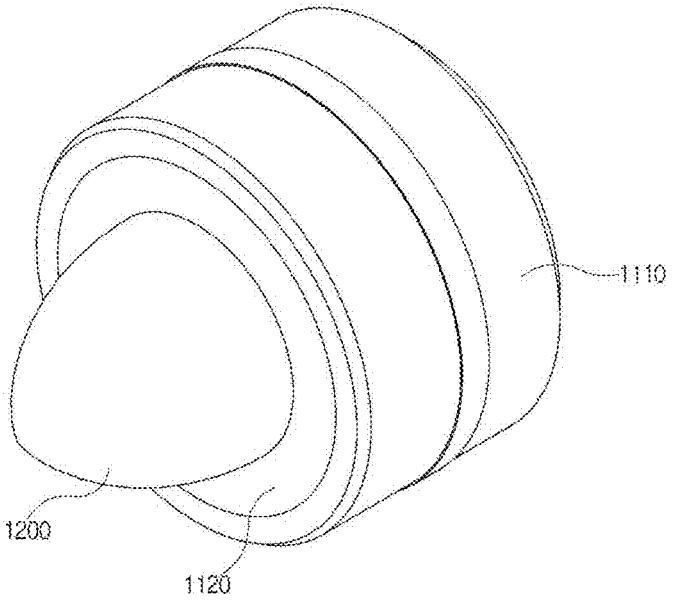
FIG. 5 is a perspective view illustrating a state in which a rail plug and a pulsation dampening part are coupled to each other in a pulsation dampening structure for the fuel rail according to an exemplary embodiment of the present disclosure.
Figure 6:
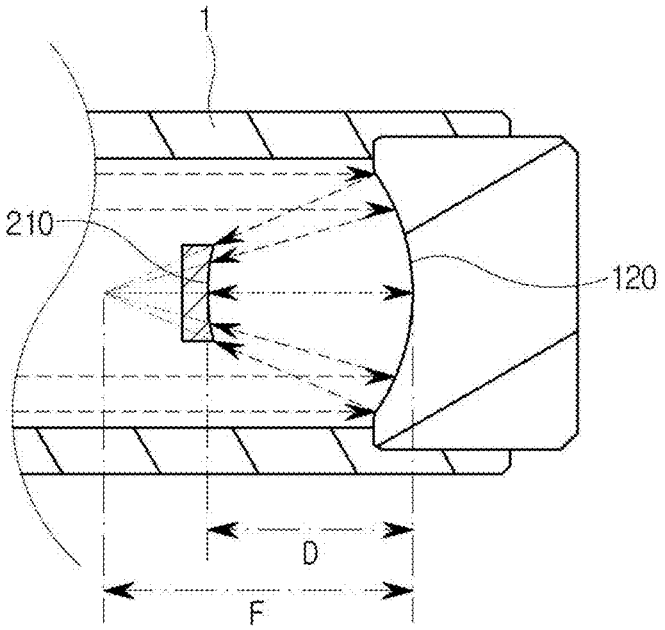
FIG. 6 is a conceptual view explaining a principle of turbulence generation in the pulsation dampening structure for the fuel rail according to an exemplary embodiment of the present disclosure.

FIGS. 1 and 5 illustrate a pulsation dampening structure for a fuel rail according to another exemplary embodiment of the present disclosure. The pulsation attenuation structure for the fuel rail according to this exemplary embodiment may include the fuel rail 1, a rail plug 1100, and a pulsation dampening part 1200.

The rail plug 1100 may include a plug body 1110 and a fuel reflecting part 1120. In particular, the plug body 1110 may be formed to be inserted into and fastened to the fuel rail 1. In the exemplary embodiment, the plug body 1110 may be formed in a cylindrical shape, but is not limited thereto and may be formed to correspond to a shape of the fuel rail 1. The fuel reflecting part 1120 may be connected to the plug body 1110 and concavely formed in the inflow direction of fuel. In particular, the fuel reflecting part 1120 may be disposed at the one side end of the fuel rail 1, which is opposite to the inflow direction of fuel, and may be formed in a shape similar to a concave mirror.

The pulsation dampening part 1200 may be formed to include a spheroidal shape which is pointed toward the inflow direction of fuel from the fuel reflecting part 1120. In the exemplary embodiment, the pulsation dampening part 1200 may be formed to protrude from the fuel rejecting part 1120 in the inflow direction of fuel and in an axial direction, may be formed such that a protruded portion includes a shape similar to that of an end portion of a rugby ball (e.g., prolate ellipsoid; see FIG. 5). In the exemplary embodiment, since the pulsation dampening part 1200 may formed to have a base diameter smaller than a diameter of the fuel reflecting part 1120, a convex portion of the pulsation dampening part 1200 may protrude from a central area of a concave surface of the fuel reflecting part 1120 (See FIG. 7).

Figure 7:
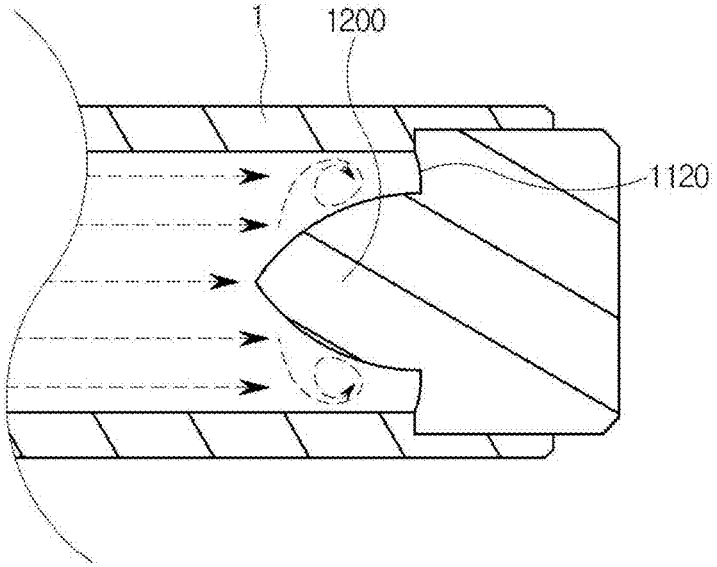
FIG. 7 is a conceptual view explaining a principle of vortex generation in the pulsation dampening structure for the fuel rail according to another exemplary embodiment of the present disclosure.

Referring to FIGS. 1, 5 and 7, the effect of the pulsation dampening structure for the fuel rail according to the exemplary embodiment is described. First, fuel entering along the fuel rail 1 may flow along a curved surface of the pulsation dampening part 1200 having a pointed spheroidal shape. Due to a shape of the curved surface of the pulsation dampening part 1200, a difference in flow velocity may occur among the fuel pathlines, and as a result, a vortex may be generated to dampen the pulsation.

In the exemplary embodiment, since the pulsation dampening part 1200 is formed to have the base diameter smaller than that of the fuel reflecting part 1120, a sufficient space may be provided in which the vortex in fuel may be generated and strengthened along the concavely curved surface of the fuel reflecting part 1120.

Figure 9:
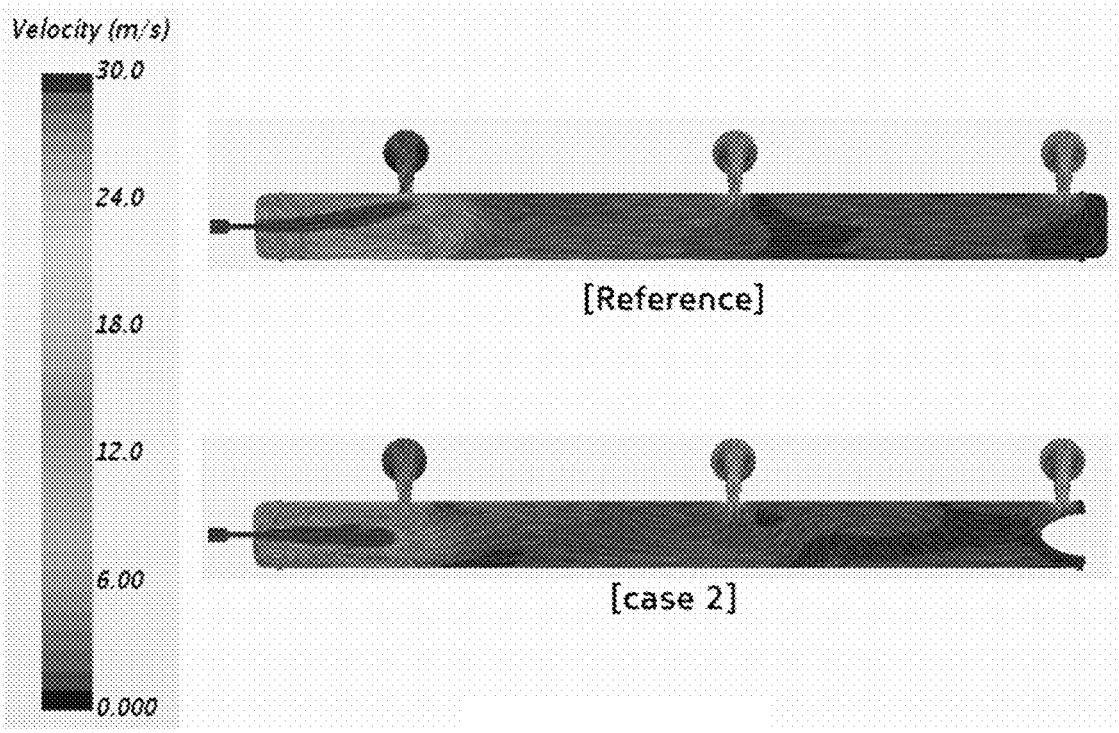
FIG. 9 is a flow analysis view indicating a fuel flow inside the fuel rail to which the pulsation dampening structure for the fuel rail according to another exemplary embodiment of the present disclosure is applied.

FIG. 9 illustrates a flow analysis view indicating the result of comparing a fuel flow inside the fuel rail to which the pulsation dampening structure for the fuel rail according to another exemplary embodiment of the present disclosure is applied (referred to as "case 2") with the fuel flow inside the conventional fuel rail (referred to as "reference"). In the conventional fuel rail in FIG. 9, the flow (bright region: flow velocity of 20 m/s or more) of fuel returns back to an inlet port with the flow (dark region: flow velocity of 30 m/s or more) of fuel flowing into the vicinity of the inlet port. In contrast, in the fuel rail to which the present disclosure is applied, the flow of fuel that returns back to an inlet port is observed less. In particular, according to the exemplary embodiment, recirculation of fuel, which is returned back to the inlet port, may be smaller, and thus, flow imbalance may be generated less.

In addition, around the end portion of the fuel rail in the direction of the rail plug, when compared to the conventional fuel rail, the region darkly represented is distributed more widely in the fuel rail to which the present disclosure is applied. The more widely distributed darkly represented region may indicate that the flow velocity in the fuel rail is low (0 m/s or more and equal to or less than 1 m/s) and that the pulsation is reduced due to the low flow velocity. Therefore, according to the exemplary embodiment, a turbulent flow may be generated in the fuel, which enters along the fuel rail 1, by the fuel reflecting part 1120 and the pulsation dampening part 1200, thereby dampening pulsation.

As described above, in exemplary embodiments of the pulsation dampening structure for the fuel rail according to the present disclosure, a turbulent flow may be caused by reflecting fuel which was entered, and a vortex may be generated in the entered fuel, thereby dampening pulsation.

Although the present disclosure has been described in detail with reference to the exemplary embodiments, the present disclosure is not limited thereto, and it will be apparent that the present disclosure may be modified or improved by those skilled in the art within the technical spirit of the present disclosure.

All of mere change or modifications of the present disclosure are embraced within the scope of the present disclosure, and specific protection scope of the present disclosure will be apparent by the appended claims.

What is claimed is:

1. A pulsation dampening structure for a vehicle, comprising:

a fuel rail;

a rail plug disposed at an end portion of the fuel rail; and a pulsation dampening part disposed on the rail plug to dampen pulsation generated when fuel enters the fuel rail, wherein the rail plug includes a plug body inserted into and coupled to the end portion of the fuel rail, and wherein the pulsation dampening part includes a turbulent flow generating portion disposed in a direction in which the fuel flows, with respect to the rail plug; and a coupling bridge connected to the turbulent flow generating portion for coupling the turbulent flow generating portion and the plug body with each other.

2. The pulsation dampening structure of claim 1, wherein the rail plug comprises:

a fuel reflecting part disposed on the plug body in an inflow direction of the fuel and concavely formed in the inflow direction of the fuel such that the fuel that enters along the fuel rail is reflected and concentrated.

3. The pulsation dampening structure of claim 1, wherein the turbulent flow generating portion is concavely formed in a direction of a fuel reflecting part to reflect the fuel, which is reflected on the fuel reflecting part, to form a vortex.

4. The pulsation dampening structure of claim 1, wherein the coupling bridge comprises:

a first bending portion formed to protrude from the turbulent flow generating portion in a radial direction and bent in a direction toward the rail plug;

an extension portion formed to extend from the first bending portion in the direction toward the rail plug;

a second bending portion formed to bend radially outwardly at the extension portion; and a coupling portion formed to extend from the second bending portion and configured to be coupled to the rail plug.

5. The pulsation dampening structure of claim 4, wherein the extension portion is formed to have a length that is less than a focal distance of a curvature of a fuel reflecting part.

6. The pulsation dampening structure of claim 1, wherein the plug body includes a plurality of coupling grooves along a circumferential direction to allow the coupling bridge to be inserted thereinto and coupled thereto.

* * * * *